US009588448B2

(12) United States Patent
Sugiyama et al.

(10) Patent No.: US 9,588,448 B2
(45) Date of Patent: Mar. 7, 2017

(54) ELECTROPHOTOGRAPHIC PHOTOSENSITIVE MEMBER, PROCESS CARTRIDGE, ELECTROPHOTOGRAPHIC APPARATUS, AND METHOD FOR PRODUCING ELECTROPHOTOGRAPHIC PHOTOSENSITIVE MEMBER

(71) Applicant: CANON KABUSHIKI KAISHA, Tokyo (JP)

(72) Inventors: Kazumichi Sugiyama, Numazu (JP); Daisuke Tanaka, Yokohama (JP); Takeshi Murakami, Numazu (JP); Daisuke Kawaguchi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/791,202

(22) Filed: Jul. 2, 2015

(65) Prior Publication Data

US 2016/0011530 A1 Jan. 14, 2016

(30) Foreign Application Priority Data

Jul. 9, 2014 (JP) ..... 2014-141766
May 25, 2015 (JP) ..... 2015-105906

(51) Int. Cl.

| | |
|---|---|
| ***G03G 15/04*** | (2006.01) |
| ***G03G 5/14*** | (2006.01) |
| ***G03G 5/05*** | (2006.01) |
| ***G03G 15/00*** | (2006.01) |

(52) U.S. Cl.

CPC ..... *G03G 5/144* (2013.01); *G03G 5/0525* (2013.01); *G03G 5/0578* (2013.01); *G03G 5/142* (2013.01); *G03G 15/00* (2013.01)

(58) Field of Classification Search

CPC .... G03G 1/142; G03G 5/0525; G03G 5/0578; G03G 15/00; G03G 5/142; G03G 5/144

See application file for complete search history.

(56) References Cited

U.S. PATENT DOCUMENTS

2014/0212806 A1* 7/2014 Sugiyama ..... G03G 5/142 430/131

FOREIGN PATENT DOCUMENTS

| | | | |
|---|---|---|---|
| JP | 2002-156772 | A | 5/2002 |
| JP | 2004-191868 | A | 7/2004 |
| JP | 2004-198734 | A | 7/2004 |
| JP | 2013-097221 | A | 5/2013 |
| JP | 2014-029479 | A | 2/2014 |

* cited by examiner

*Primary Examiner* — Thorl Chea

(74) *Attorney, Agent, or Firm* — Canon U.S.A. Inc., IP Division

(57) ABSTRACT

An electrophotographic photosensitive member includes an undercoat layer containing a resin and a metal oxide particle whose surface has been treated with a compound represented by formula (1), and the resin is a polymerized product of a composition containing a compound having a group represented by formula (2) and a polyol.

13 Claims, 1 Drawing Sheet

ELECTROPHOTOGRAPHIC PHOTOSENSITIVE MEMBER, PROCESS CARTRIDGE, ELECTROPHOTOGRAPHIC APPARATUS, AND METHOD FOR PRODUCING ELECTROPHOTOGRAPHIC PHOTOSENSITIVE MEMBER

BACKGROUND OF THE INVENTION

Field of the Invention

The present invention relates to an electrophotographic photosensitive member, a process cartridge and an electrophotographic apparatus each including an electrophotographic photosensitive member, and a method for producing an electrophotographic photosensitive member.

Description of the Related Art

An electrophotographic photosensitive member used in an electrophotographic apparatus includes an undercoat layer containing a metal oxide particle and provided between a support and a photosensitive layer. The metal oxide particle is surface-treated with a silane coupling agent for suppressing black-dot image defects due to charge injection into the photosensitive layer side from the support.

Japanese Patent Laid-Open No. 2004-191868 describes that an undercoat layer of an electrophotographic photosensitive member contains a urethane resin and a metal oxide particle surface-treated with a silane coupling agent having an amino group.

Also, a urethane resin which is a curable resin is used as a binder resin (resin) in the undercoat layer. When a curable resin is used as a binder resin of an undercoat layer, from the viewpoint of productivity of the electrophotographic photosensitive member, it is required that curing at a low temperature (production of a curable resin at a low temperature) can be performed. Therefore, Japanese Patent Laid-Open No. 2004-198734 describes that an undercoat layer contains a curable resin produced by reaction of a polyvinylbutyral resin with a compound having an isocyanate group blocked with a diethyl malonate structure.

A silane coupling agent has, in a molecule thereof, both a hydrolyzable group which reacts with a metal oxide particle and modifies the surfaces thereof and an organic functional group which has an interaction with a binder resin. Since reactivity with the binder resin varies with the type of the organic functional group, it is required to select the organic functional group suitable for the binder resin used in the undercoat layer. When reactivity with the binder resin varies with the type of the organic functional group, black dots may be easily produced by aggregation of surface-treated metal oxide particles.

As a result of investigation of an undercoat layer using a curable resin (urethane resin) produced by reaction of polyol with a compound represented by formula (2) below, the inventors found the following problem. That is, when the urethane resin and metal oxide particle surface-treated with a silane coupling agent having an amino group or a mercapto group are used in the undercoat layer, a change in light-area potential may be easily increased in a high-temperature-high-humidity environment.

(2)

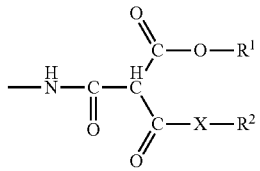

In the formula (2), X represents a single bond or an oxygen atom, and $R^1$ and $R^2$ each independently represent an alkyl group having 1 to 4 carbon atoms. When in the formula (2), X is an oxygen atom and $R^1$ and $R^2$ are each an ethyl group, the formula has a diethyl malonate structure.

An object of the present invention is to provide an electrophotographic photosensitive member in which both a change in light-area potential in a high-temperature high-humidity environment and black dots are suppressed at a high level. Another object of the present invention is to provide a process cartridge and an electrophotographic apparatus each including the electrophotographic photosensitive member. A further object of the present invention is to provide a method for producing the electrophotographic photosensitive member.

SUMMARY OF THE INVENTION

Aspects of the present invention relate to an electrophotographic photosensitive member including a support, an undercoat layer on the support, and a photosensitive layer on the undercoat layer. The undercoat layer contains a resin, and a metal oxide particle whose surface has been treated with a compound represented by formula (1) below.

The resin is a polymerized product of a composition containing a compound having a group represented by formula (2) below and a polyol.

(1)

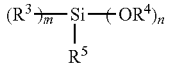

In the formula (1), $R^3$ and $R^4$ each independently represent an alkyl group having 1 to 2 carbon atoms or a phenyl group, $R^5$ represents a group selected from an alkyl group having 1 to 10 carbon atoms, a vinyl group, a methacryloyloxy group, or an acryloyloxy group, m and n each represents an integer, m+n=3, and m=0, 1, or 2.

Also, aspects of the present invention relate to a process cartridge detachable from an electrophotographic apparatus body. The process cartridge includes the electrophotographic photosensitive member and at least one selected from the group consisting of a charging unit, a development unit, a transfer unit, and a cleaning unit, and the electrophotographic photosensitive member and the at least one unit are integrally supported.

Further, aspects of the present invention relate to an electrophotographic apparatus including the electrophotographic photosensitive member, a charging unit, an exposure unit, a development unit, and a transfer unit.

Further, aspects of the present invention relate to a method for producing an electrophotographic photosensitive member including a support, an undercoat layer formed on the support, and a photosensitive layer formed on the undercoat layer.

The method includes the steps of, preparing a coating solution for an undercoat layer, the coating solution containing a metal oxide particle whose surface has been treated with a compound represented by the formula (1), a compound having a group represented by the formula (2), and polyol; and forming the undercoat layer by forming a film of the coating solution for an undercoat layer and drying and curing the film.

According to aspects of the present invention, it is possible to provide an electrophotographic photosensitive member in which both a change in light-area potential in a high-temperature high-humidity environment and black dots are satisfactorily suppressed at a high level. Also, according to aspects of the present invention, it is possible to provide a process cartridge and an electrophotographic apparatus each including the electrophotographic photosensitive member. Further, according to aspects of the present invention, it is possible to provide a method for producing the electrophotographic photosensitive member.

Further features of the present invention will become apparent from the following description of exemplary embodiments with reference to the attached drawings.

DESCRIPTION OF THE EMBODIMENTS

Figure 1A:
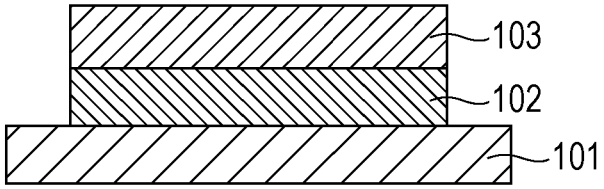
FIGS. 1A and 1B are drawings each showing an example of a layer configuration of an electrophotographic photosensitive member.

An electrophotographic photosensitive member of the present invention includes a support, an undercoat layer formed on the support, and a photosensitive layer formed on the undercoat layer. The undercoat layer contains a resin and a metal oxide particle whose surface has been treated with a compound represented by formula (1) below. The resin is a polymerized product of a composition containing a compound having a group represented by formula (2) below and a polyol.

(1)

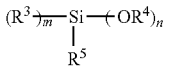

In the formula (1), $R^3$ and $R^4$ each independently represent an alkyl group having 1 to 2 carbon atoms or a phenyl group, $R^5$ represents a group selected from an alkyl group having 1 to 10 carbon atoms, a vinyl group, a methacryloyloxy group, or an acryloyloxy group, m and n each represents an integer, m+n=3, and m=0, 1, or 2.

(2)

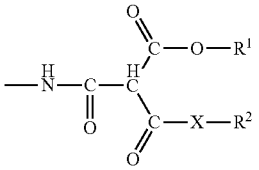

In the formula (2), X represents a single bond or an oxygen atom, and $R^1$ and $R^2$ each independently represent an alkyl group having 1 to 4 carbon atoms. X is preferably a single bond.

The inventors suppose that when the undercoat layer of the electrophotographic photosensitive member has the characteristics described above, both a change in light-area potential in a high-temperature high-humidity environment and black dots are satisfactorily suppressed at a high level for the reason below.

As described above, when the undercoat layer includes a polymer (urethane resin) of a composition which contains a compound having a group represented by the formula (2) and a polyol, and a metal oxide particle which is surface-treated with a silane coupling agent having an amino group or a mercapto group, a change in light-area potential is easily increased. The conceivable reason for this is that since an amino group and a mercapto group are hydrophilic groups and thus have high affinity for water molecules, water molecules easily adsorb on oxygen deficient portions of the metal oxide particle surface-treated with a silane coupling agent. Accordingly, it is considered that the resistance of the undercoat layer is increased, and charge is easily stayed in the undercoat layer, thereby increasing a change in light-area potential.

Therefore, as a result of investigation performed by the inventors, it was found that in order to suppress the a change in light-area potential in a high-temperature high-humidity environment, it is effective to change the organic functional group of the silane coupling agent from a hydrophilic group to a hydrophobic group. Specifically, an alkyl group having 1 to 2 carbon atoms or a phenyl group is used as an organic functional group $R^3$ in the formula (1). It is considered that by using the silane coupling agent, adsorption of water molecules on the oxygen deficient portions of the metal oxide particle is suppressed, and the a change in light-area potential is suppressed.

Further, according to the constitution of the present invention, in addition to the suppression of a change in light-area potential, black dots can also be suppressed. It is generally known that when the organic functional group of the silane coupling agent is changed from a hydrophilic group to a hydrophobic group, dispersibility of the metal oxide particles is easily decreased, and thus black dots easily occur. In the present invention, it is supposed that the metal oxide particles are easily uniformly dispersed in the undercoat layer due to interaction (coordination) between the metal oxide particles and the urethane resin produced by reaction of a polyol with a compound having a group represented by the formula (2). Specifically, it is considered that a structure represented by formula (3) is formed by interaction between the urethane resin and the metal oxide particles. It is also considered that the black dots are suppressed by the interaction.

(3)

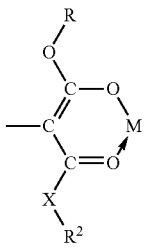

In the formula (3), R represents a structure on the polyol side in ester exchange reaction between the formula (2) and the polyol, M represents a metal element of metal oxide, and X and $R^2$ each represent the same as in the formula (2).

Examples of an alkyl group having 1 to 4 carbon atoms represented by each of $R^1$ and $R^2$ in the formula (2) include a methyl group, an ethyl group, a propyl group (a n-propyl group and an isopropyl group), and a butyl group (a n-butyl group, an isobutyl group, and a tert-butyl group). Among these, a methyl group and an ethyl group are preferred. Also, the case where X in the formula (2) represents a single bond represents that C on the left of X and $R^2$ on the right of X are directly bonded to each other.

Examples of a compound (silane coupling agent) represented by the formula (1) and used for surface treatment of the metal oxide particle include vinyltrimethoxysilane, vinyltriethoxysilane, 3-methacryloyloxypropylmethyl dimethoxysilane, 3-methacryloyloxypropyl trimethoxysilane, 3-methacryloyloxypropylmethyl diethoxysilane, 3-methacryloyloxpropyl triethoxysilane, and 3-acryloyloxypropyl trimethoxysilane.

Examples of a compound (silane agent) represented by the formula (1) and used for surface treatment of the metal oxide particle include methyl trimethoxysilane, dimethyl dimethoxysilane, phenyl trimethoxysilane, methyl triethoxysilane, dimethyl diethoxysilane, phenyl triethoxysilane, hexyl trimethoxysilane, hexyl triethoxysilane, and decyl trimethoxysilane.

Among these compounds represented by the formula (1), the silane agent is preferred from the viewpoint of reactivity with the resin used in the undercoat layer. The silane agent having an alkyl group having 1 to 10 carbon atoms as $R^5$ is more preferred.

The metal oxide particle is not particularly limited as long as the particle is used for imparting conductivity to the undercoat layer. In particular, a particle containing at least one metal oxide selected from the group consisting of zinc oxide, titanium oxide, and tin oxide is preferred.

A method for surface-treating the metal oxide particle may be any one of known methods. For example, a dry method or a wet method may be used. The dry method is a method in which an alcohol aqueous solution, an organic solvent solution, or an aqueous solution of the silane coupling agent is added to metal oxide particles in a mixer capable of high-speed stirring, such as a Henschel mixer, under stirring of the metal oxide particles, and the metal oxide particles are uniformly dispersed and then dried. The wet method includes dispersing the metal oxide particles and the silane coupling agent by stirring in a solvent or by using a sand mill using glass beads, and then removing the solvent by filtration or reduced-pressure distillation. After the solvent is removed, baking is preferably performed at 100° C. or more.

The compound having a group represented by the formula (2) can be produced by reacting an isocyanate group of an isocyanate compound with, for example, dialkyl malonate, acetoacetate esters, or the like.

Examples of the isocyanate compound include 2,4-tolylenediisocyanate, 2,6-tolylenediisocyanate, diphenylmethane-4,4'-diisocyanate, 1-isocyanato-3,3,5-trimethyl-5-isocyanatomethylcyclohexane (isophoronediisocyanate, IPDI), hexamethylenediisocyanate (HDI), HDI-trimethylolpropane adduct, HDI-isocyanurate, and HDI-biuret. Among these, from the viewpoint of suppressing adsorption of water molecules on the metal oxide particle, aliphatic diisocyanates such as hexamethylene diisocyanate, isophorone diisocyanate, and the like are preferred. In addition, the isocyanate compound having an isocyanurate as a central skeleton is preferred. These isocyanate compounds may be used alone or in combination of two or more.

Examples of dialkyl malonate include dimethyl malonate, diethyl malonate, di(isopropyl) malonate, di(n-propyl) malonate, di(n-butyl) malonate, di(tert-butyl) malonate, tert-butylethyl malonate, and the like. Examples of acetoacetate esters include methyl acetoacetate, ethyl acetoacetate, isopropyl acetoacetate, n-propyl acetoacetate, tert-butyl acetoacetate, and the like.

Examples of the polyol include polyvinyl acetal, polyphenol, polyethylenediol, polycarbonatediol, polyether polyol, polyacryl polyol, and the like. Among these, polyvinyl acetal is preferred. The polyol resins may be used alone or in combination of two or more.

From the viewpoint of electric characteristics, the mass ratio (Mm/Mu) of the mass (Mm) of the metal oxide particle contained in the undercoat layer to the total mass (Mu) the composition containing the compound having a group represented by the formula (2) and the polyol is preferably 1/1 or more (mass ratio), and more preferably 2/1 or more (mass ratio). On the other hand, from the viewpoint of suppressing the occurrence of cracking in the undercoat layer, the mass ratio (Mm/Mu) is preferably 4/1 or less (mass ratio). Therefore, the mass ratio (Mm/Mu) is preferably 2/1 or more and 4/1 or less (mass ratio).

In addition, from the viewpoint of adjusting the surface roughness of the undercoat layer and suppressing the occurrence of cracking in the undercoat layer, the undercoat layer may contain an organic resin particle, a leveling agent, or the like.

Examples of the organic resin particle include hydrophobic organic resin particles such as a silicone particle, hydrophilic organic resin particles such as a polymethyl methacrylate (PMMA) particle, and the like.

Further, the undercoat layer may contain various additives for improving film shape stability and improving image quality.

Examples of the additives include metal particles such as an aluminum particle, a copper particle, and the like, conductive particles such as carbon black and the like, quinone compounds, fluorenone compounds, oxadiazole compounds, diphenoquinone compounds, alizalin compounds, benzophenone compounds, polycyclic condensed compounds, azo compounds, metal chelate compounds, and silane coupling agents.

The undercoat layer of the present invention can be formed through steps described below. First, a coating solution for an undercoat layer containing the metal oxide particle surface-treated with a compound represented by the formula (1), a compound having a group represented by the formula (2), and the polyol is prepared. Next, a film of the coating solution for an undercoat layer is formed, dried, and cured to form the undercoat layer.

From the viewpoint of storage stability of the coating solution, the coating solution preferably contains an alcohol as a solvent used in the coating solution for an undercoat layer.

The alcohol contained in the coating solution for an undercoat layer is preferably a monohydric alcohol. Examples thereof include methanol, ethanol, propanol (such as 1-propanol), butanol (such as 1-butanol), methoxypropanol (such as 1-methoxy-2-propanol), cyclohexanol, benzyl alcohol, and the like. Among these, ethanol, propanol, butanol, methoxypropanol, and cyclohexanol are preferred. These alcohols may be used alone or in combination of two or more.

From the viewpoint of storage stability, the content of alcohol is preferably 1 equivalent or more relative to the group represented by the formula (2). Also, from the viewpoint of dispersibility of the metal oxide particle, the content of alcohol is preferably 90% by mass or less relative to the total amount of the solvent in the coating solution for an undercoat layer. The content is particularly preferably 50% by mass or less.

A solvent used in combination of the alcohol as the solvent in the coating solution for an undercoat layer is not particularly limited as long as it satisfies dispersibility of the metal oxide particle and well dissolves the materials of the undercoat layer. The solvent can be arbitrarily selected from ketone solvents, ether solvents, ester solvents, halogenated hydrocarbon solvents, aromatic solvents, and the like. Examples of the solvent include tetrahydrofuran, methanol, methyl cellosolve, methoxy propanol, acetone, methyl ethyl ketone, cyclohexanone, methyl acetate, ethyl acetate, and dioxane. These solvents for the coating solution for an undercoat layer can be used alone or as a mixture of two or more.

The drying temperature (heating temperature) of the film of the coating solution for an undercoat layer is preferably 100° C. or more and 190° C. or less. Within this range, cracking of the undercoat layer is suppressed, and polymerization reaction (curing reaction) of a composition containing a compound having a group represented by the formula (2) and polyol easily proceeds. The drying temperature is more preferably 130° C. or more and 155° C. or less. Also, the drying time (heating time) of the film of the coating solution for an undercoat layer is preferably 10 minutes or more and 120 minutes or less and more preferably 10 minutes or more and 60 minutes or less.

The coating solution for an undercoat layer can be prepared by dispersing the metal oxide particle, the polyol, the compound having a group represented by the formula (2), and the solvent. A dispersion method is, for example, a method using a dispersion apparatus such as a paint shaker, a ball mill, a sand mill, a roll mill, or the like. Examples of a dispersion medium used in the dispersion apparatus include spherical glass beads, alumina beads, zirconia beads, and the like. The particle diameter (diameter) of the beads is preferably 0.3 mm or more and 1.0 mm or less.

From the viewpoint of suppressing the a change in light-area potential due to repeated use of the electrophotographic photosensitive member, the thickness of the undercoat layer is preferably 0.5 μm or more and 40 μm or less and more preferably 0.5 μm or more and 10 μm or less.

When the conductive layer is not provided, from the viewpoint of covering (coating) flaws on the support, the thickness of the undercoat layer is preferably 10 μm or more and 40 μm or less and more preferably 15 μm or more and 35 μm or less.

The electrophotographic photosensitive member of the present invention includes the support, the undercoat layer formed on the support, and the photosensitive layer formed on the undercoat layer. The electrophotographic photosensitive member preferably includes, as the photosensitive layer, a stacked-type photosensitive layer including a charge generation layer provided on the undercoat layer and a charge transport layer provided on the charge generation layer. A charge transport material contained in the charge transport layer is preferably a hole transport material.

Figure 1B:
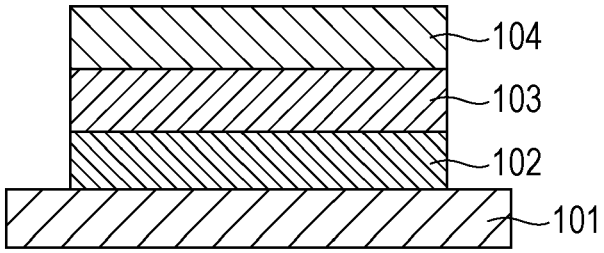

FIGS. 1A and 1B are drawings each showing an example of a layer configuration of an electrophotographic photosensitive member. In FIG. 1A, reference numeral 101 denotes a support, reference number 102 denotes an undercoat layer, and reference numeral 103 denotes a single-layer photosensitive layer. In FIG. 1B, reference numeral 101 denotes a support, reference number 102 denotes an undercoat layer, reference numeral 103 denotes a charge generation layer, and reference numeral 104 denotes a charge transport layer.

The support preferably has conductivity (conductive support) and is, for example, a support made of a metal (alloy) such as aluminum, an aluminum alloy, stainless steel, copper, nickel, zinc, or the like. When the support made of aluminum or an aluminum alloy is used, an ED pipe, an EI pipe, or the like can be used.

Also, a metal support or a resin support on which a thin film of a conductive material, such as aluminum, an aluminum alloy, an indium oxide-tin oxide alloy, or the like, is formed can be used as the support.

In addition, for the purpose of suppressing interference fringes due to scattering of a laser beam, the surface of the support may be subjected to cutting treatment, roughening treatment, alumite treatment, electrolytic composite polishing treatment, wet honing treatment, or dry honing treatment. The electrolytic composite polishing represents polishing by electrolysis with an electrode having an electrolytic function and an electrolyte solution, and a grinding stone having a polishing function.

For the purpose of suppressing interference fringes due to scattering of a laser beam and of covering (coating) flaws on the support, the conductive layer may be provided between the support and the undercoat layer.

The conductive layer can be formed by first forming a film of a coating solution for a conductive layer, the coating solution being prepared by dispersing a conductive particle such as carbon black, a metal particle, a metal oxide particle, or the like, a binder resin (or a monomer and/or oligomer thereof), and a solvent. Then, the film is dried and/or cured.

Examples of the binder resin which can be used for the conductive layer include polyester, polycarbonate, polyvinyl butyral, acryl resins, silicone resins, epoxy resins, melamine resins, urethane resins, phenol resins, alkyd resins, and the like.

Examples of the solvent in the coating solution for a conductive layer include ether solvents, alcohol solvents, ketone solvents, aromatic hydrocarbon solvents, and the like. These solvents may be used alone or in combination or two or more.

The thickness of the conductive layer is preferably 5 μm or more and 40 μm or less and more preferably 10 μm or more and 30 μm or less.

The undercoat layer is provided between the support or the conductive layer and the photosensitive layer (the charge generation layer and the charge transport layer).

The photosensitive layer (the charge generation layer and the charge transport layer) is provided on the undercoat layer.

When the photosensitive layer is the stacked-type photosensitive layer, the charge generation layer is formed on the undercoat layer. The charge generation layer can be formed by applying a coating solution for a charge generation layer prepared by dispersing a charge generation material, a binder resin, and a solvent to form a film, and then drying the film. The charge generation layer may include a vapor deposited film of the charge generation material.

A dispersion method is, for example, a method using a homogenizer, an ultrasonic disperser, a ball mill, a sand mill, a roll mill, a vibrating mill, an attritor, a liquid collision-type high-speed disperser, or the like.

Examples of the charge generation material include azo pigments, phthalocyanine pigments, indigo pigments, perylene pigments, polycyclic quinone pigments, squarylium dyes, thiapyrylium salts, triphenylmethane dyes, quinacridone pigments, azulenium salt pigments, cyanine dyes, anthanthrone pigments, pyranthrone pigments, xanthene dyes, quinoneimine dyes, styryl dyes, and the like. From the viewpoint of sensitivity, among these, oxytitanium phthalocyanine, chlorogallium phthalocyanine, and hydroxygallium phthalocyanine are preferred, and hydroxygallium phthalocyanine is more preferred. In particular, the hydroxygallium phthalocyanine is preferably a hydroxygallium phthalocyanine crystal having a crystal form having peaks at Bragg angles 2θ of 7.4°±0.3° and 28.2°±0.3° in CuKα characteristic X-ray diffraction. These charge generation materials may be used alone or in combination of two or more.

Examples of the binder resin used in the charge generation layer include polycarbonate, polyester, butyral resins, polyvinyl acetal, acrylic resins, vinyl acetate resins, urea resins, and the like. Among these, butyral resins are preferred. These binder resins may be used alone or in combination as a mixture or a copolymer of two or more.

Examples of the solvent used in the coating solution for a charge generation layer include alcohol solvents, sulfoxide solvents, ketone solvents, ether solvents, ester solvents, aromatic hydrocarbon solvents and the like. These solvents may be used alone or in combination or two or more.

The thickness of the charge generation layer is preferably 0.01 μm or more and 5 μm or less and more preferably 0.1 μm or more and 2 μm or less.

If required, the charge generation lay can further contain a sensitizer, an antioxidant, an ultraviolet absorber, a plasticizer, and the like.

In the electrophotographic photosensitive member having the stacked-type photosensitive layer, the charge transport layer is formed on the charge generation layer.

The charge transport layer can be formed by applying a coating solution for a charge transport layer prepared by dissolving a charge transport material and a binder resin in a solvent to form a film, and then drying the film.

Examples of the charge transport material (hole transport material) include triarylamine compounds, hydrazone compounds, styryl compounds, stilbene compounds, butadiene compounds, and the like. Among these, triarylamine compounds are preferred. These charge transport materials may be used alone or in combination of two or more.

Examples of the binder resin used in the charge transport layer include acrylic resins, acrylonitrile resins, allyl resins, alkyd resins, epoxy resins, silicone resins, phenol resins, phenoxy resins, polyacrylamide, polyamide-imide, polyamide, polyallyl ether, polyarylate, polyimide, urethane resins, polyester, polyethylene, polycarbonate, polysulfone, polyphenylene oxide, polybutadiene, polypropylene, methacryl resins, and the like. Among these, polyarylate and polycarbonate are preferred. These binder resins may be used alone or in combination as a mixture or copolymer of two or more.

Examples of the solvent used in the coating solution for a charge transport layer include alcohol solvents, sulfoxide solvents, ketone solvents, ether solvents, ester solvents, aromatic hydrocarbon solvents, and the like. These solvents may be used alone or in combination of two or more.

The ratio by mass (charge transport material/binder resin) of the charge transport material to the binder resin contained in the charge transport layer is preferably 0.3/1 or more and 10/1 or less.

The heating temperature (drying temperature) of the film of the coating solution for a charge transport layer is preferably 60° C. or more and 150° C. or less and more preferably 80° C. or more and 130° C. or less. Also, the heating time (drying time) is preferably 10 minutes or more and 60 minutes or less.

When the charge transport layer possessed by the electrophotographic photosensitive member is a single layer, the thickness of the charge transport layer is preferably 5 μm or more and 40 μm or less and more preferably 8 μm or more and 30 μm or less.

When the charge transport layer has a stacked structure, the thickness of the charge transport layer on the support side is preferably 5 μm or more and 30 μm or less, and the thickness of the charge transport layer on the surface side is preferably 1 μm or more and 10 μm or less.

If required, the charge transport lay may further contain an antioxidant, an ultraviolet absorber, a plasticizer, and the like.

Also, in the present invention, a protective layer may be provided on the photosensitive layer (charge transport layer) for the purpose of improving durability and cleaning properties of the electrophotographic photosensitive member.

The protective layer can be formed by applying a coating solution for a protective layer prepared by dissolving a resin (or a monomer and/or oligomer thereof) in a solvent to form a film, and then drying and/or curing the film.

Examples of the resin used in the protective layer include polyvinylbutyral, polyester, polycarbonate, polyamide, polyimide, polyarylate, urethane resins, acryl resins, methacryl resins, styrene-butadiene copolymers, styrene-acrylic acid copolymers, styrene-acrylonitrile copolymers, and the like. Among these, acryl resins and methacryl resins are preferred. These resins may be used alone or in combination of two or more.

Also, in order to impart a charge transport ability to the protective layer, the protective layer (second charge transport layer) may be formed by curing a monomer having a charge transport ability (hole transport ability) using any one of various polymerization reaction and crosslinking reaction. Specifically, the protective layer (second charge transport layer) is preferably formed by curing a charge transport material (hole transport material) having a chain-polymerizable functional group through polymerization or crosslinking.

Examples of the chain-polymerizable functional group include an acryloyloxy group, a methacryloyloxy group, an alkoxysilyl group, an epoxy group, and the like. A curing reaction is, for example, a radial polymerization reaction, an ionic polymerization reaction, or the like. Also, heat, light such as ultraviolet light, radiation such as an electron beam, or the like ca be used for the curing reaction.

If required, the protective layer can further contain a conductive particle, an ultraviolet absorber, an abrasion resistance-improving agent, and the like. For example, the conductive particle is a metal oxide particle such as a tin oxide particle or the like. The abrasion resistance-improving agent is, for example, a fluorine atom-containing resin particle such as a polytetrafluoroethylene particle or the like, alumina, silica, or the like.

The thickness of the protective layer is preferably 0.5 μm or more and 20 μm or less and more preferably 1 μm or more and 10 μm or less.

The coating solution for each of the layers can be applied by using a coating method such as a dip coating method, a spray coating method, a spinner coating method, a roller coating method, a Meyer bar coating method, a blade coating method, or the like.

Figure 2:
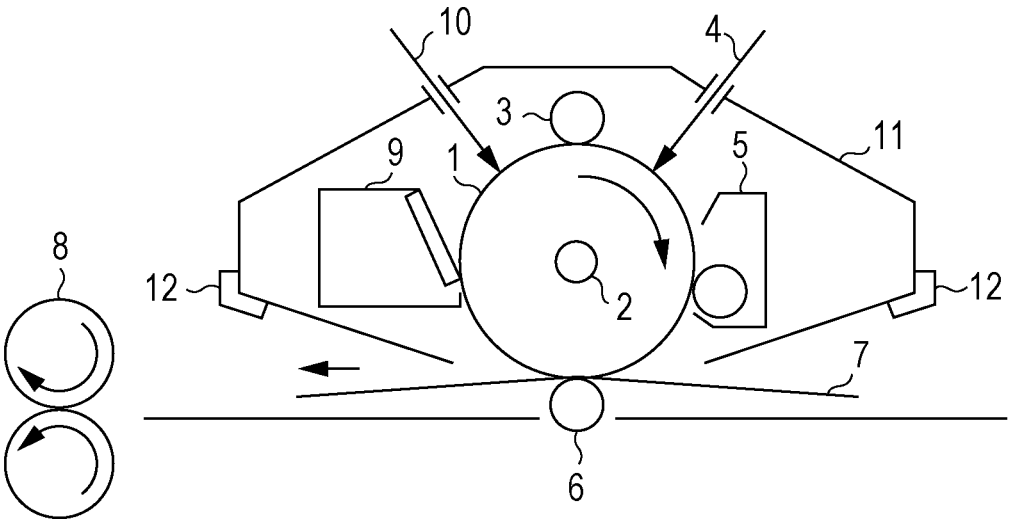
FIG. 2 is a drawing showing an example of a schematic configuration of an electrophotographic apparatus including a process cartridge having an electrophotographic photosensitive member.

FIG. 2 shows a schematic configuration of an electrophotographic apparatus provided with a process cartridge including the electrophotographic photosensitive member of the present invention.

In FIG. 2, a drum-shaped electrophotographic photosensitive member 1 of the present invention is rotatively driven at a predetermined peripheral speed (process speed) around an axis 2 in a direction of an arrow.

The surface (periphery) of the electrophotographic photosensitive member 1 is charged to a predetermined positive or negative potential by a charging unit 3 (primary charging unit: charging roller) in a rotation process.

Next, the surface of the electrophotographic photosensitive member 1 is irradiated with exposure light (image exposure light) 4 from an exposure unit (image exposure unit).

As a result, an electrostatic latent image is formed on the surface of the electrophotographic photosensitive member 1.

The electrostatic latent image formed on the surface of the electrophotographic photosensitive member 1 is then developed (normally developed or reversely developed) with a developer (toner) in a development unit 5 to form a toner image on the surface of the electrophotographic photosensitive member 1.

Next, the toner image formed on the surface of the electrophotographic photosensitive member 1 is transferred to a transfer material 7 by a transfer unit 6 (transfer roller or the like).

The transfer material 7 is taken out from a transfer material feed unit (not shown) synchronously with the rotation of the electrophotographic photosensitive member 1 and is fed to a contact portion between the electrophotographic photosensitive member 1 and the transfer unit 6.

In addition, a voltage (transfer bias) with a polarity reverse to the charge possessed by the toner is applied to the transfer unit 6 from a bias power supply (not shown).

The transfer material 7 to which the toner image has been transferred is separated from the surface of electrophotographic photosensitive member 1, delivered to a fixing unit 8 in which the toner image is fixed, and then printed out as an image-formed substance (print or copy) to the outside of the electrophotographic apparatus.

The transfer unit 6 may be an intermediate transfer-type transfer unit including a primary transfer member, an intermediate transfer member, and a secondary transfer member.

After the toner image has been transferred to the transfer material 7, the surface of the electrophotographic photosensitive member 1 is cleaned by a cleaning unit 9 (cleaning blade or the like) to remove adhering materials such as the transfer residual developer (transfer residual toner).

The transfer residual toner can be recovered by a development unit (cleaner-less system).

Further, the surface of the electrophotographic photosensitive member 1 is destaticized by irradiation with pre-exposure light 10 from a pre-exposure unit (not shown) and then repeatedly used for image formation.

As shown in FIG. 2, when the charging unit 3 is a contact charging unit using a charging roller, pre-exposure is not necessarily required.

In the present invention, a plurality of components selected from the electrophotographic photosensitive member 1, the charging unit 3, the development unit 5, the transfer unit 6, and the cleaning unit 9 may be held in a container and integrally combined as a process cartridge.

The process cartridge may be configured to be detachable from the electrophotographic apparatus body. For example, the electrophotographic photosensitive member 1 and at least one of the charging unit 3, the development unit 5, and the cleaning unit 9 are integrally supported in a cartridge. The cartridge can be used as a process cartridge 11 which is detachable from the electrophotographic apparatus body using a guide unit 12 such as a rail or the like of the electrophotographic apparatus body.

Examples of the exposure light 4 include reflected light and transmitted light from an original, and light irradiated by laser beam scanning, LED array driving, or liquid crystal shutter array driving performed according to a signal obtained by reading an original, and the like.

EXAMPLES

The present invention is described in further below by giving examples. However, the present invention is not limited to these examples. In the examples, "parts" represents "parts by mass".

Example 1

Preparation of Coating Solution 1 for Undercoat Layer

First, 100 parts of zinc oxide particle (average particle diameter: 50 nm, specific surface area (hereinafter a "BET value"): 19 $m^2/g$, powder resistance: $3.7\times10^5$ Ω·cm) was mixed with 500 parts of toluene under stirring. Then, 0.75 parts of isobutyl trimethoxysilane (trade name: Z-2306 manufactured by Dow Corning Toray Co., Ltd.) serving as a surface treatment agent was added to the resultant mixture and mixed under stirring for 6 hours. Then, toluene was distilled off under reduced pressure, and the residue was dried at 140° C. for 6 hours to produce a zinc oxide particle surface-treated with the surface treatment agent.

Next, 18 parts of polyvinyl acetal as a polyol (butyral resin, trade name: BM-1, manufactured by Sekisui Chemical Co., Ltd.), 20 parts of a solution of a compound having a group represented by the formula (2) (X: a single bond, $R^1$: an ethyl group, $R^2$: a methyl group) (the compound having an isocyanurate-type triisocyanurate (including a polymer such as a pentamer or a higher polymer) as a central skeleton, content of the compound: 60% by mass (balance: solvent)) were dissolved in a mixed solvent containing 70 parts of methyl ethyl ketone and 70 parts of 1-butanol to prepare a solution.

Then, 81 parts of the surface-treated zinc oxide particle and 0.8 parts of 2,3,4-trihydroxybenzophenone (manufactured by Tokyo Chemical Industry Co., Ltd.) were added to the resultant solution, and then the resultant mixture was placed in a vertical sand mill using 200 parts of glass beads having an average particle diameter of 1.0 mm as a dispersion medium. Then, dispersion was performed under the condition of a rotational speed of 1500 rpm (peripheral speed of 5.5 m/s) for 4 hours in an environment at a temperature of 23±3° C.

After dispersion, 0.01 parts of silicone oil (trade name: SH28PA, manufactured by Dow Corning Toray Co., Ltd.) was added to the resultant dispersion solution. Further, 6.4 parts of crosslinked polymethyl methacrylate (PMMA) particle (trade name: TECHPOLYMERSSX-102, manufactured by Sekisui Chemical Co., Ltd., average primary particle diameter: 3.0 μm) was added and stirred to form a coating solution 1 for an undercoat layer.

Formation of Electrophotographic Photosensitive Member 1

An aluminum cylinder (JIS-A3003, an aluminum alloy ED pipe, manufactured by Showa Aluminum Corporation) having a length of 357.5 mm and a diameter of 30 mm and produced by hot extrusion in an environment at a temperature of 23° C. and a humidity of 60% RH was used as a support.

Next, the coating solution 1 for an undercoat layer was stirred by rotation with a roll stand at 1 turn/sec for 1 day and then applied to the support by dip coating to form a film. The resultant film of the coating solution for an undercoat layer was dried and cured by heating at 150° C. for 30 minutes to form an undercoat layer having a thickness of 30 μm.

Next, 2 parts of polyvinyl butyral (trade name: S-Lec BX-1, manufactured by Sekisui Chemical Co., Ltd.) was dissolved in 100 parts by cyclohexanone. Then, 4 parts of hydroxygallium phthalocyanine crystal (charge generation material) having a crystal form having peaks at Bragg angles 2θ±0.2° of 7.4° and 28.1° in CuKα characteristic X-ray diffraction, and 0.04 parts of a compound represented by formula (A) below were added to the resultant solution.

(A)

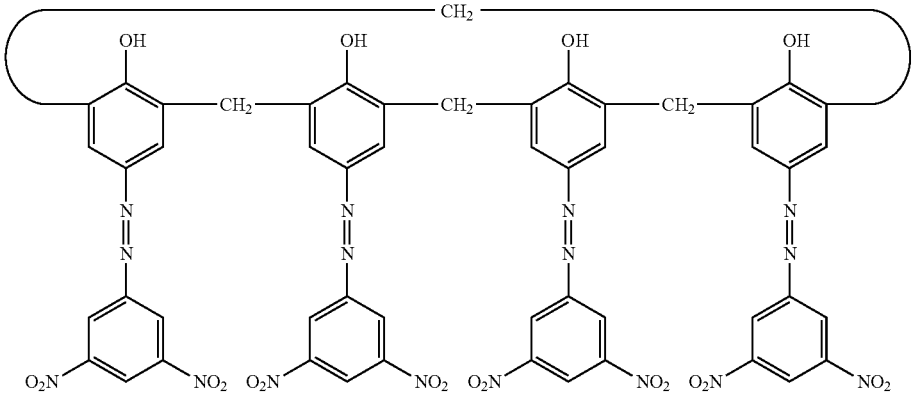

The resultant mixture was placed in a sand mill using glass beads having a diameter of 1 mm and dispersed for 1 hour in an environment at 23±3° C. After dispersion, 100 parts of ethyl acetate was added to the resultant dispersion solution to prepare a coating solution for a charge generation layer. The coating solution for a charge generation layer was applied to the undercoat layer by dip coating, and the resultant film was dried at 90° C. for 10 minutes to form a charge generation layer having a thickness of 0.20 μm.

Next, 50 parts of an amine compound (charge transport material (hole transport material)) represented by formula (B) below, (B)

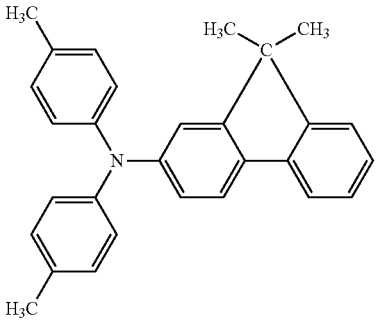

50 parts of an amine compound (charge transport material (hole transport material)) represented by formula (C) below, and (C)

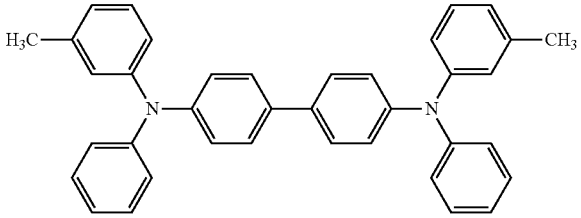

100 parts of polycarbonate (trade name: Iupilon 2400, manufactured by Mitsubishi Gas Chemical Company Inc.) were dissolved in a mixed solvent containing 650 parts of chlorobenzene and 150 parts by dimethoxymethane to prepare a coating solution for a charge transport layer. The resultant coating solution for a charge transport layer was allowed to stand for 1 day and then applied to the charge generation layer by dip coating, and the resultant film was dried at 110° C. for 30 minutes to form a charge transport layer having a thickness of 21 μm.

Next, 36 parts of a compound represented by formula (D) below.

(D)

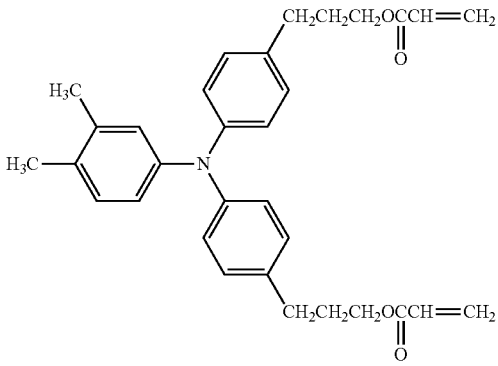

4 parts of polytetrafluoroethylene particle (trade name: Ruburon L-2, manufactured by Daikin Industries, Ltd), and 60 parts of n-propyl alcohol were mixed, and the resultant mixture was placed in a high-pressure disperser and dispersed to prepare a coating solution for a protective layer (coating solution for a second charge transport layer).

The coating solution for a protective layer was applied to the charge transport layer by dip coating to form a film, and the film was dried at 50° C. for 5 minutes. After drying, the film was irradiated with an electron beam while the support was rotated in a nitrogen atmosphere under the conditions including an acceleration voltage of 70 kV and an amount of absorbed light of 8000 Gy for 1.6 seconds. Then, the film was heated in a nitrogen atmosphere for 3 minutes under conditions in which the film was at 130° C. In addition, the oxygen concentration from irradiation with an electron beam to heating for 3 minutes was 20 ppm. Next, the film was heated in the air for 30 minutes under conditions in which the film was at 100° C. to form a protective layer (second charge transport layer) having a thickness of 5 μm.

Consequently, a drum-shaped electrophotographic photosensitive member (photosensitive drum) 1 having the support, the undercoat layer, the charge generation layer, the charge transport layer, and the protective layer provided in that order was produced.

Next, evaluation is described.

Evaluation of a Change in Light-Area Potential in Repeated Use

A modified machine (modified so that a process speed was 300 mm/s, and a charging unit was of a type of applying a voltage in which an AC voltage was superimposed on a DC voltage to a charging roller) of a copying machine (trade name: GP405) manufactured by Canon Kabushiki Kaisha was used as an evaluation apparatus. The electrophotographic photosensitive member produced as described above was provided on a drum cartridge of the evaluation apparatus and evaluated as described below.

The evaluation apparatus was installed in an environment at room temperature and normal humidity (23° C./50% RH) and an environment at high temperature and high humidity (30° C./85% RH). Charging conditions included a peak-to-peak voltage of 1500 V in an AC component of the voltage applied to the charging roller, a frequency of 1500 Hz, and a DC component of −850 V. Exposure conditions were adjusted so that when the surface of the electrophotographic photosensitive member was irradiated with a laser beam as image exposure light, an initial light-area potential ($Vl_A$) (before the repeated use) was −200 V. The exposure conditions were adjusted for each of electrophotographic photosensitive members including electrophotographic photosensitive members of examples and comparative examples described below.

The surface potential of the electrophotographic photosensitive member was measured by fixing a potential probe (trade name: Model 6000 B-8, manufactured by Trek Inc.) to a development cartridge removed from the evaluation apparatus and connecting a surface potentiometer (trade name, Model 344, manufactured by Trek Inc.) to the potential probe. The position of the potential probe relative to the electrophotographic photosensitive member was located at a center in the axial direction of the electrophotographic photosensitive member and separated by 3 mm from the surface of the electrophotographic photosensitive member.

Next, evaluation of a change in light-area potential in repeated use in the room-temperature normal-humidity environment is described. The evaluation was performed without changing the initial charging conditions and exposure conditions.

The electrophotographic photosensitive member was allowed to stand in an environment at room temperature and normal humidity (23° C./50% RH) for 24 hours. Then, the electrophotographic photosensitive member was attached to a drum cartridge, and the drum cartridge was provided on the evaluation apparatus in which 50000 images were then output (the electrophotographic photosensitive member was repeatedly used by feeding paper).

After 50000 images had been output, the electrophotographic photosensitive member was allowed to stand for 5 minutes, and then a development cartridge was replaced with a potential measurement device including the potential probe and the surface potentiometer to measure the light-area potential ($Vl_{NB}$) of the surface the electrophotographic photosensitive member after output of 50000 images (after repeated use). In addition, a change in light-area potential $\Delta Vl_N$ ($\Delta Vl_N=|Vl_{NB}|-|Vl_{NA}|$) of the surface of the electrophotographic photosensitive member in repeated use was calculated. $Vl_{NA}$ was −200 V which was the light-area potential ($Vl_A$) before repeated use. In this case, $Vl_{NA}$ was the light-area potential of the surface of the electrophotographic photosensitive member before repeated use (initial stage). In addition, $|Vl_{NB}|$ and $|Vl_{NA}|$ represent absolute values of $Vl_{NB}$ and $Vl_{NA}$, respectively.

Next, the evaluation of a change in light-area potential in repeated use in a high-temperature high-humidity environment is described. The evaluation was performed without changing the initial charging conditions and exposure conditions.

An electrophotographic photosensitive member produced under the same conditions as described above was allowed to stand in an environment at high temperature and high humidity (30° C./85% RH) for 72 hours. Then, the electrophotographic photosensitive member was attached to a drum cartridge, and the drum cartridge was provided on the evaluation apparatus in which 50000 images were then output (the electrophotographic photosensitive member was repeatedly used by feeding paper).

After 50000 images had been output, the electrophotographic photosensitive member was allowed to stand for 5 minutes, and then a development cartridge was replaced with a potential measurement device including the potential probe and the surface potentiometer to measure the light-area potential ($Vl_{HB}$) of the surface the electrophotographic photosensitive member after output of 50000 images (after repeated use). In addition, a change in light-area potential $\Delta Vl_H$ ($\Delta Vl_H=|Vl_{HB}|-|Vl_{HA}|$) of the surface of the electrophotographic photosensitive member in repeated use was calculated. $Vl_{HA}$ was −200 V which was the light-area potential ($Vl_A$) before repeated use. In this case, $Vl_{HA}$ was the light-area potential of the surface of the electrophotographic photosensitive member before repeated use (initial stage). In addition, $|Vl_{HB}|$ and $|Vl_{HA}|$ represent absolute values of $Vl_{HB}$ and $Vl_{HA}$, respectively.

An index $\Delta Vl$ for evaluating an environmental change in the change in light-area potential after repeated use was calculated from the changes in light-area potential ($\Delta Vl_N$ and $\Delta Vl_H$) in the two environments. That is, the environmental resistance of the electrophotographic photosensitive member was evaluated from the level of difference $\Delta Vl$ ($\Delta Vl=|\Delta Vl_H|-|\Delta Vl_N|$) between the change in light-area potential ($\Delta Vl_N$) in repeated use in the room-temperature normal-humidity environment and the change in light-area potential ($\Delta Vl_H$) in repeated use in the high-temperature high-humidity environment. In addition, $|\Delta Vl_N|$ and $|\Delta Vl_N|$ represent the absolute values of $\Delta Vl_H$ and $\Delta Vl_N$, respectively. The results are shown in Table 2.

Further, the produced electrophotographic photosensitive member 1 was attached to a copying machine (trade name: GP405) manufactured by Canon Kabushiki Kaisha, and a solid white image (A4 paper) was output and evaluated for black dots. The output direction of A4 paper was the direction of the short side of A4 paper. The charging unit of the copying machine was a contact charging unit including a charging roller, and a voltage in which an AC voltage was superimposed on a DC voltage was applied to the charging roller.

The evaluation criteria (ranks and numbers) of black dots in the output solid white image are as follows.

In the output solid white image, the number of black dots was evaluated in a rectangular area (referred to as an "area corresponding to one round of the electrophotographic photosensitive member 1" hereinafter) having a length of 297 mm corresponding to the long side length of A4 paper and a width of 94.2 mm corresponding to one round of the drum-shaped electrophotographic photosensitive member 1.

A: 0 black dot with a diameter of 0.3 mm or more in an area corresponding to one round of the electrophotographic photosensitive member 1 in the solid white image.

B: 1 or more and 3 or less black dots with a diameter of 0.3 mm or more in an area corresponding to one round of the electrophotographic photosensitive member 1 in the solid white image.

C: 4 black dots with a diameter of 0.3 mm or more in an area corresponding to one round of the electrophotographic photosensitive member 1 in the solid white image.

D: 5 black dots with a diameter of 0.3 mm or more in an area corresponding to one round of the electrophotographic photosensitive member 1 in the solid white image.

E: 6 or more black dots with a diameter of 0.3 mm or more in an area corresponding to one round of the electrophotographic photosensitive member 1 in the solid white image.

The results (ranks of black dots) are shown in Table 2.

Examples 2 to 5

The BET value of zinc oxide particle used for preparing the coating solution for an undercoat layer and the amount of treatment of the zinc oxide particle with isobutyl trimethoxysilane used as a surface treatment agent in Example 1 were changed as shown in Table 1. With the exception of this, an electrophotographic photosensitive member was produced and evaluated by the same method as in Example 1. The results are shown in Table 1.

Example 6

The surface treatment agent of metal oxide particle was changed from isobutyl trimethoxysilane in Example 1 to dimethyl dimethoxysilane (trade name: Z-6329, manufactured by Dow Corning Toray Co., Ltd.). With the exception of this, an electrophotographic photosensitive member was produced and evaluated by the same method as in Example 1. The results are shown in Table 1.

Example 7

The surface treatment agent was changed from isobutyl trimethoxysilane in Example 1 to diisobutyl dimethoxysilane (trade name: Z-6275, manufactured by Dow Corning Toray Co., Ltd.). With the exception of this, an electrophotographic photosensitive member was produced and evaluated by the same method as in Example 1. The results are shown in Table 1.

Example 8

The surface treatment agent was changed from isobutyl trimethoxysilane in Example 1 to n-hexyl trimethoxysilane (trade name: Z-6583, manufactured by Dow Corning Toray Co., Ltd.). With the exception of this, an electrophotographic photosensitive member was produced and evaluated by the same method as in Example 1. The results are shown in Table 1.

Example 9

The surface treatment agent was changed from isobutyl trimethoxysilane in Example 1 to n-octyl triethoxysilane (trade name: Z-6341, manufactured by Dow Corning Toray Co., Ltd.). With the exception of this, an electrophotographic photosensitive member was produced and evaluated by the same method as in Example 1. The results are shown in Table 1.

Example 10

The surface treatment agent was changed from isobutyl trimethoxysilane in Example 1 to n-decyl trimethoxysilane (trade name: Z-6210, manufactured by Dow Corning Toray Co., Ltd.). With the exception of this, an electrophotographic photosensitive member was produced and evaluated by the same method as in Example 1. The results are shown in Table 1.

Example 11

The surface treatment agent was changed from isobutyl trimethoxysilane in Example 1 to vinyl trimethoxysilane (trade name: KBM-1003, manufactured by Shin-Etsu Chemical Co., Ltd.). With the exception of this, an electrophotographic photosensitive member was produced and evaluated by the same method as in Example 1. The results are shown in Table 1.

Example 12

The surface treatment agent was changed from isobutyl trimethoxysilane in Example 1 to 3-methacryloyloxypropylmethyl dimethoxysilane (trade name: KBM-502, manufactured by Shin-Etsu Chemical Co., Ltd.). With the exception of this, an electrophotographic photosensitive member was produced and evaluated by the same method as in Example 1. The results are shown in Table 1.

Example 13

The surface treatment agent was changed from isobutyl trimethoxysilane in Example 1 to 3-acryloyloxypropyl trimethoxysilane (trade name: KBM-5103, manufactured by Shin-Etsu Chemical Co., Ltd.). With the exception of this, an electrophotographic photosensitive member was produced and evaluated by the same method as in Example 1. The results are shown in Table 1.

Examples 14 and 15

The adding amount of zinc oxide particle surface-treated with isobutyl trimethoxysilane used for preparing the coating solution for an undercoat layer in Example 1 was changed as shown in Table 1. With the exception of this, an electrophotographic photosensitive member was produced and evaluated by the same method as in Example 1. The results are shown in Table 1.

Example 16

In Example 1, 18 parts of polyvinylacetal used for preparing the coating solution for an undercoat layer was changed to 18 parts of polyacrylpolyol (trade name: Burnock WE-300, manufactured by DIC Corporation). Further, 20 parts of a solution of a compound having a group represented by the formula (2) was changed to 16 parts of a solution of a compound having a group represented by the formula (2) (X: an oxygen atom, $R^1$: an ethyl group, $R^2$: an ethyl group) (the compound having isocyanurate-type triisocyanurate as a central skeleton (including a polymer such as a pentamer or higher polymer), content of the compound: 75% by mass (balance: solvent)). With the exception of this, an electrophotographic photosensitive member was produced and evaluated by the same method as in Example 1. The results are shown in Table 1.

Example 17

The zinc oxide particle in Example 1 was changed to a titanium oxide particle (average particle diameter: 70 nm, BET value: 15 $m^2/g$, powder resistance: $3.2\times10^5$ Ω·cm). With the exception of this, an electrophotographic photosensitive member was produced and evaluated by the same method as in Example 1. The results are shown in Table 1.

Example 18

The zinc oxide particle in Example 1 was changed to an antimony-doped tin oxide particle (average particle diameter: 50 nm, specific surface area: 20 $m^2/g$, powder resistance: $6.9\times10^6$ Ω·cm). With the exception of this, an electrophotographic photosensitive member was produced and evaluated by the same method as in Example 1. The results are shown in Table 1.

Example 19

In Example 1, 0.8 parts of 2,3,4-trihydroxybenzophenone was not added. With the exception of this, an electrophotographic photosensitive member was produced and evaluated by the same method as in Example 1. The results are shown in Table 1.

Example 20

In Example 1, 0.8 parts of 2,3,4-trihydroxybenzophenone was changed to 0.8 parts of alizarin (1,2-dihydroxyanthraquinone) (manufactured by Tokyo Chemical Industries, Inc.). With the exception of this, an electrophotographic photosensitive member was produced and evaluated by the same method as in Example 1. The results are shown in Table 1.

Examples 21 and 22

In Example 1, 1-butanol used in the coating solution for an undercoat layer was changed to an alcohol shown in Table 1. With the exception of this, an electrophotographic photosensitive member was produced and evaluated by the same method as in Example 1. The results are shown in Table 1.

Comparative Example 1

The surface treatment agent was changed from isobutyl trimethoxysilane in Example 1 to N-2-(aminoethyl)-3-aminopropyl trimethoxysilane (trade name: KBM-603, manufactured by Shin-Etsu Chemical Co., Ltd.). With the exception of this, an electrophotographic photosensitive member was produced and evaluated by the same method as in Example 1. The results are shown in Table 2.

Comparative Example 2

The surface treatment agent was changed from isobutyl trimethoxysilane in Example 17 to N-2-(aminoethyl)-3-aminopropyl trimethoxysilane (trade name: KBM-603). With the exception of this, an electrophotographic photosensitive member was produced and evaluated by the same method as in Example 1. The results are shown in Table 2.

Comparative Example 3

The surface treatment agent was changed from isobutyl trimethoxysilane in Example 1 to 3-mercaptopropyl trimethoxysilane (trade name: KBM-803, manufactured by Shin-Etsu Chemical Co., Ltd.). With the exception of this, an electrophotographic photosensitive member was produced and evaluated by the same method as in Example 1. The results are shown in Table 2.

Comparative Example 4

In Example 1, a zinc oxide particle was not surface-treated. With the exception of this, an electrophotographic photosensitive member was produced and evaluated by the same method as in Example 1. The results are shown in Table 2.

Comparative Example 5

In Example 1, 20 parts of a solution of a compound having a group represented by the formula (2) was changed to 16 parts of a solution of blocked isocyanate not having a group represented by the formula (2) but having an isocyanate group blocked with methyl ethyl ketone oxime (the isocyanate having isocyanurate-type triisocyanurate as a central skeleton (including a polymer such as a pentamer or higher polymer, content of the compound: 75% by mass (balance: solvent), hereinafter referred to as "isocyanate 1"). Further, the drying conditions of the film of the coating solution for an undercoat layer were changed from 150° C. and 30 minutes to 165° C. and 30 minutes. With the exception of this, an electrophotographic photosensitive member was produced and evaluated by the same method as in Example 1. The results are shown in Table 2.

Comparative Example 6

In Example 1, 20 parts of a solution containing a compound having a group represented by the formula (2) was changed to 16 parts of a solution of blocked isocyanate not having a group represented by the formula (2) but having an isocyanate group blocked with dimethylpyrazole (the isocyanate having isocyanurate-type triisocyanurate as a central skeleton (including a polymer such as a pentamer or higher polymer), content of the compound: 75% by mass (balance: solvent), hereinafter referred to as "isocyanate 2"). With the exception of this, an electrophotographic photosensitive member was produced and evaluated by the same method as in Example 1. The results are shown in Table 2.

Comparative Example 7

In Example 1, 18 parts of polyvinylacetal (trade name: BM-1) and 20 parts of a solution of a compound having a group represented by the formula (2) were changed to 30 parts of phenol resin (trade name: Pryophen J325, manufactured by Dainippon Ink & Chemicals Inc.). With the exception of this, an electrophotographic photosensitive member was produced and evaluated by the same method as in Example 1. The results are shown in Table 2.

Comparative Example 8

In Example 1, 18 parts of polyvinylacetal (trade name: BM-1) and 20 parts of a solution of a compound having a group represented by the formula (2) were changed to 15 parts of N-methoxynylon and 3 parts of copolymerized nylon. Further, the drying conditions of the film of the coating solution for an undercoat layer were changed from 150° C. and 30 minutes to 100° C. and 20 minutes, and the thickness of the undercoat layer was changed to 2.0 μm. With the exception of this, an electrophotographic photosensitive member was produced and evaluated by the same method as in Example 1. The results are shown in Table 2.

TABLE 1

| Example | Metal oxide particle: Metal type | Metal oxide particle: BET value | Metal oxide particle: Parts by mass | Surface treatment: Type of silane agent | Surface treatment: Relative to Mox (% by mass) | Surface treatment: Compound having group represented by (2) | Surface treatment: Alcohol | ΔVI | Black dot |
|---|---|---|---|---|---|---|---|---|---|
| 1 | Zinc oxide | 19 | 81 | Isobutyltrimethoxysilane | 0.75% | X: single bond, R1: ethyl group, R2: methyl group | 1-Butanol | 8 | A |
| 2 | Zinc oxide | 19 | 81 | Isobutyltrimethoxysilane | 0.30% | X: single bond, R1: ethyl group, R2: methyl group | 1-Butanol | 12 | B |
| 3 | Zinc oxide | 19 | 81 | Isobutyltrimethoxysilane | 1.5% | X: single bond, R1: ethyl group, R2: methyl group | 1-Butanol | 10 | B |
| 4 | Zinc oxide | 30 | 81 | Isobutyltrimethoxysilane | 1.5% | X: single bond, R1: ethyl group, R2: methyl group | 1-Butanol | 15 | C |
| 5 | Zinc oxide | 10 | 81 | Isobutyltrimethoxysilane | 0.40% | X: single bond, R1: ethyl group, R2: methyl group | 1-Butanol | 8 | A |
| 6 | Zinc oxide | 19 | 81 | Dimethyldimethoxysilane | 0.75% | X: single bond, R1: ethyl group, R2: methyl group | 1-Butanol | 14 | B |
| 7 | Zinc oxide | 19 | 81 | Diisobutyldimethoxysilane | 0.75% | X: single bond, R1: ethyl group, R2: methyl group | 1-Butanol | 12 | A |
| 8 | Zinc oxide | 19 | 81 | n-Hexyltrimethoxysilane | 0.75% | X: single bond, R1: ethyl group, R2: methyl group | 1-Butanol | 9 | A |
| 9 | Zinc oxide | 19 | 81 | n-Octyltriethoxysilane | 0.75% | X: single bond, R1: ethyl group, R2: methyl group | 1-Butanol | 15 | A |
| 10 | Zinc oxide | 19 | 81 | n-Decyltrimethoxysilane | 0.75% | X: single bond, R1: ethyl group, R2: methyl group | 1-Butanol | 17 | B |
| 11 | Zinc oxide | 19 | 81 | Vinyltrimethoxysilane | 0.75% | X: single bond, R1: ethyl group, R2: methyl group | 1-Butanol | 3 | B |
| 12 | Zinc oxide | 19 | 81 | 3-Methacryloyloxypropyl-methyldimethoxysilane | 0.75% | X: single bond, R1: ethyl group, R2: methyl group | 1-Butanol | 11 | A |
| 13 | Zinc oxide | 19 | 81 | 3-Acryloyloxypropyl-trimethoxysilane | 0.75% | X: single bond, R1: ethyl group, R2: methyl group | 1-Butanol | 11 | A |
| 14 | Zinc oxide | 19 | 60 | Isobutyltrimethoxysilane | 0.75% | X: single bond, R1: ethyl group, R2: methyl group | 1-Butanol | 9 | A |
| 15 | Zinc oxide | 19 | 120 | Isobutyltrimethoxysilane | 0.75% | X: single bond, R1: ethyl group, R2: methyl group | 1-Butanol | 8 | C |
| 16 | Zinc oxide | 19 | 81 | Isobutyltrimethoxysilane | 0.75% | X: oxygen atom, R1: ethyl group, R2: ethyl group | 1-Butanol | 11 | A |
| 17 | Titanium oxide | 15 | 81 | Isobutyltrimethoxysilane | 0.75% | X: single bond, R1: ethyl group, R2: methyl group | 1-Butanol | 8 | B |
| 18 | Tin oxide | 20 | 81 | Isobutyltrimethoxysilane | 0.75% | X: single bond, R1: ethyl group, R2: methyl group | 1-Butanol | 9 | B |
| 19 | Zinc oxide | 19 | 81 | Isobutyltrimethoxysilane | 0.75% | X: single bond, R1: ethyl group, R2: methyl group | 1-Butanol | 16 | A |
| 20 | Zinc oxide | 19 | 81 | Isobutyltrimethoxysilane | 0.75% | X: single bond, R1: ethyl group, R2: methyl group | 1-Butanol | 7 | A |
| 21 | Zinc oxide | 19 | 81 | Isobutyltrimethoxysilane | 0.75% | X: single bond, R1: ethyl group, R2: methyl group | Cyclohexanol | 11 | A |
| 22 | Zinc oxide | 19 | 81 | Isobutyltrimethoxysilane | 0.75% | X: single bond, R1: ethyl group, R2: methyl group | Benzyl alcohol | 8 | B |

45

TABLE 2

| Comparative Example | Metal oxide particle: Metal type | Metal oxide particle: BET value | Metal oxide particle: Parts by mass | Surface treatment: Type of silane agent | Surface treatment: Relative to Mox (% by mass) | Surface treatment: Compound having group represented by (2) | Surface treatment: Alcohol | ΔVI | Black dot |
|---|---|---|---|---|---|---|---|---|---|
| 1 | Zinc oxide | 19 | 81 | N-2-(aminoethyl)-3-aminopropyl trimethoxysilane | 0.75% | X: single bond, R1: ethyl group, R2: methyl group | 1-Butanol | 30 | A |
| 2 | Titanium oxide | 15 | 81 | N-2-(aminoethyl)-3-aminopropyl trimethoxysilane | 0.75% | X: single bond, R1: ethyl group, R2: methyl group | 1-Butanol | 27 | A |
| 3 | Zinc oxide | 19 | 81 | 3-Mercaptopropyltrimethoxysilane | 0.75% | X: single bond, R1: ethyl group, R2: methyl group | 1-Butanol | 40 | A |
| 4 | Zinc oxide | 19 | 81 | — | — | X: single bond, R1: ethyl group, R2: methyl group | 1-Butanol | 12 | E |
| 5 | Zinc oxide | 19 | 81 | Isobutyltrimethoxysilane | 0.75% | Blocked isocyanate 1 | 1-Butanol | 17 | D |

TABLE 2-continued

| | Metal oxide particle | | | Surface treatment | | | | | |
|---|---|---|---|---|---|---|---|---|---|
| | | | | | Relative to | | | | |
| Comparative Example | Metal type | BET value | Parts by mass | Type of silane agent | Mox (% by mass) | Compound having group represented by (2) | Alcohol | ΔVI | Black dot |
| 6 | Zinc oxide | 19 | 81 | Isobutyltrimethoxysilane | 0.75% | Blocked isocyanate 2 | 1-Butanol | 16 | D |
| 7 | Zinc oxide | 19 | 81 | Isobutyltrimethoxysilane | 0.75% | Phenol resin | 1-Butanol | 31 | C |
| 8 | Zinc oxide | 19 | 81 | Isobutyltrimethoxysilane | 0.75% | N-methoxynylon | 1-Butanol | 28 | C |

Tables 1 and 2 indicate that both a change in light-area potential in a high-temperature high-humidity environment and black dots can be suppressed by using metal oxide surface-treated with a compound represented by the formula (1), and a polymerized product of a composition containing a compound having a group represented by the formula (2) and a polyol.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-141766, filed Jul. 9, 2014 and Japanese Patent Application No. 2015-105906, filed May 25, 2015, which are hereby incorporated by reference herein in their entirety.

What is claimed is:

1. An electrophotographic photosensitive member comprising:

an electrically conductive support;

an undercoat layer on the support; and a photosensitive layer on the undercoat layer, wherein the undercoat layer includes:

a resin; and a metal oxide particle whose surface has been treated with a compound represented by the following formula (1):

the resin is a polymerized product of a composition containing a compound having a group represented by the following formula (2), and a polyol,

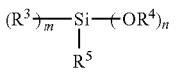

(1)

wherein, in the formula (1), $R^3$ and $R^4$ each independently represent an alkyl group having 1 to 2 carbon atoms or a phenyl group, $R^5$ represents an alkyl group having 1 to 10 carbon atoms, a vinyl group, a methacryloyloxy group, or an acryloyloxy group, m and n each represent an integer, m+n=3, and m=0, 1, or 2,

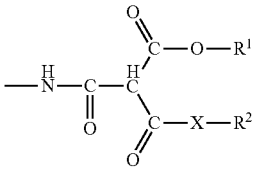

(2)

wherein, in the formula (2), X represents a single bond or an oxygen atom, and $R^1$ and $R^2$ each independently represent an alkyl group having 1 to 4 carbon atoms.

2. The electrophotographic photosensitive member according to claim 1, wherein in the formula (1), $R^5$ represents an alkyl group having 1 to 10 carbon atoms.

3. The electrophotographic photosensitive member according to claim 1, wherein the metal oxide particle is a particle containing at least one metal oxide selected from the group consisting of zinc oxide, titanium oxide, and tin oxide.

4. The electrophotographic photosensitive member according to claim 1, wherein in the formula (2), X represents a single bond.

5. The electrophotographic photosensitive member according to claim 1, wherein a mass ratio (Mm/Mu) of the mass (Mm) of the metal oxide particle to the total mass (Mu) of the composition containing the compound having a group represented by the formula (2) and the polyol in the undercoat layer is 2/1 or more and 4/1 or less.

6. A process cartridge which is detachable from an electrophotographic apparatus body, the process cartridge comprising:

the electrophotographic photosensitive member according to claim 1; and at least one selected from a charging unit, a development unit, a transfer unit, and a cleaning unit, wherein the electrophotographic photosensitive member and the at least one unit are integrally supported.

7. An electrophotographic apparatus comprising the electrophotographic photosensitive member according to claim 1, a charging unit, an exposure unit, a development unit, and a transfer unit.

8. A method for producing an electrophotographic photosensitive member comprising a support, an undercoat layer on the support, and a photosensitive layer on the undercoat layer, the method comprising the following steps of:

preparing a coating solution for an undercoat layer containing a metal oxide particle whose surface has been treated with a compound represented by the following formula (1), a compound having a group represented by the following formula (2), and a polyol; and forming a film of the coating solution for an undercoat layer, and drying and curing the film to form the undercoat layer,

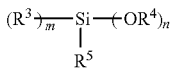

(1)

wherein, in the formula (1), $R^3$ and $R^4$ each independently represent an alkyl group having 1 to 2 carbon atoms or a phenyl group, $R^5$ represents an alkyl group having 1 to 10 carbon atoms, a vinyl group, a methacryloyloxy group, or an acryloyloxy group, m and n each represent an integer, m+n=3, and m=0, 1, or 2, (2)

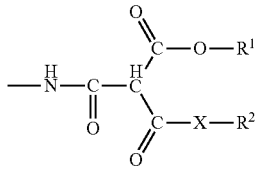

wherein, in the formula (2), X represents a single bond or an oxygen atom, and $R^1$ and $R^2$ each independently represent an alkyl group having 1 to 4 carbon atoms.

9. The method according to claim 8, wherein the coating solution for an undercoat layer contains an alcohol.

10. The method according to claim 8, wherein in the formula (1), $R^5$ represents an alkyl group having 1 to 10 carbon atoms.

11. The method according to claim 8, wherein the metal oxide particle is a particle containing at least one metal oxide selected from the group consisting of zinc oxide, titanium oxide, and tin oxide.

12. The method according to claim 8, wherein in the formula (2), X represents a single bond.

13. The method according to claim 8, wherein a mass ratio (Mm/Mu) of the mass (Mm) of the metal oxide particle to the total mass (Mu) of the composition containing the compound having a group represented by the formula (2) and the polyol in the undercoat layer is 2/1 or more and 4/1 or less.

* * * * *